United States Patent [19]

Stormont

[11] 4,004,887

[45] Jan. 25, 1977

[54] CATALYTIC CONVERTER HAVING A RESILIENT THERMAL-VARIATION COMPENSATING MONOLITH-MOUNTING ARRANGEMENT

[75] Inventor: James D. Stormont, Grass Lake, Mich.

[73] Assignee: Tenneco Inc., Racine, Wis.

[22] Filed: Mar. 16, 1973

[21] Appl. No.: 342,264

[52] U.S. Cl. ..... 23/288 FC; 60/299

[51] Int. Cl.[2] ..... F01N 3/15; F01N 7/00; F01N 7/16

[58] Field of Search ..... 23/288 F, 288 FC; 138/140; 60/299, 322

[56] References Cited

UNITED STATES PATENTS

| | | | |
|---|---|---|---|
| 991,861 | 5/1911 | Lemberg | 23/288 F |
| 1,422,211 | 7/1922 | Lamb | 23/288 F |
| 2,063,325 | 12/1936 | McLeod | 138/140 |
| 3,094,394 | 6/1963 | Innes et al. | 23/288 F |
| 3,166,895 | 1/1965 | Slayter et al. | 23/288 FC |
| 3,248,188 | 4/1966 | Chute | 23/277 C |
| 3,441,381 | 4/1969 | Keith et al. | 23/288 F |
| 3,445,196 | 5/1969 | Thomas | 23/288 FC |
| 3,798,006 | 3/1974 | Balluff | 23/288 FC |
| 3,801,289 | 4/1974 | Wiley | 23/288 FC |
| 3,814,589 | 6/1974 | Heitland | 23/288 FC |
| 3,817,714 | 6/1974 | Wiley | 23/288 FC |
| 3,841,839 | 10/1974 | Wiley | 23/288 FC |
| 3,841,842 | 10/1974 | Wiley | 23/288 FC |
| 3,852,042 | 12/1974 | Wagner | 23/288 FC |

*Primary Examiner*—Morris O. Wolk
*Assistant Examiner*—Bradley Garris
*Attorney, Agent, or Firm*—Harness, Dickey & Pierce

[57] ABSTRACT

A monolithic refractory catalytic converter unit of the type used in internal combustion engine exhaust systems has a resilient mounting ring for the catalyst element which compensates for differences in axial expansion between the element and container.

12 Claims, 8 Drawing Figures

CATALYTIC CONVERTER HAVING A RESILIENT THERMAL-VARIATION COMPENSATING MONOLITH-MOUNTING ARRANGEMENT

BRIEF SUMMARY OF THE INVENTION

It is the purpose of this invention to minimize mechanical damage, caused by thermal stresses, to monolithic refractory catalyst elements of the type shown in U.S. Pat. No. 3,441,381 and used in emission control devices for motor vehicles.

Differential thermal expansion between the catalyst element and its container can result in substantial clearance or interference between the element and the mounting members. When there is clearance, the element can move and be cracked, chipped, or extruded; and when there is interference the element can be crushed, leading to clearance and associated damage.

The invention aims to reduce this type of damage by means of a special mounting member that is resilient and which has a coefficient of expansion that tends to reduce interference and clearance.

DESCRIPTION OF THE INVENTION

Figures 1, 2, 3, 4:
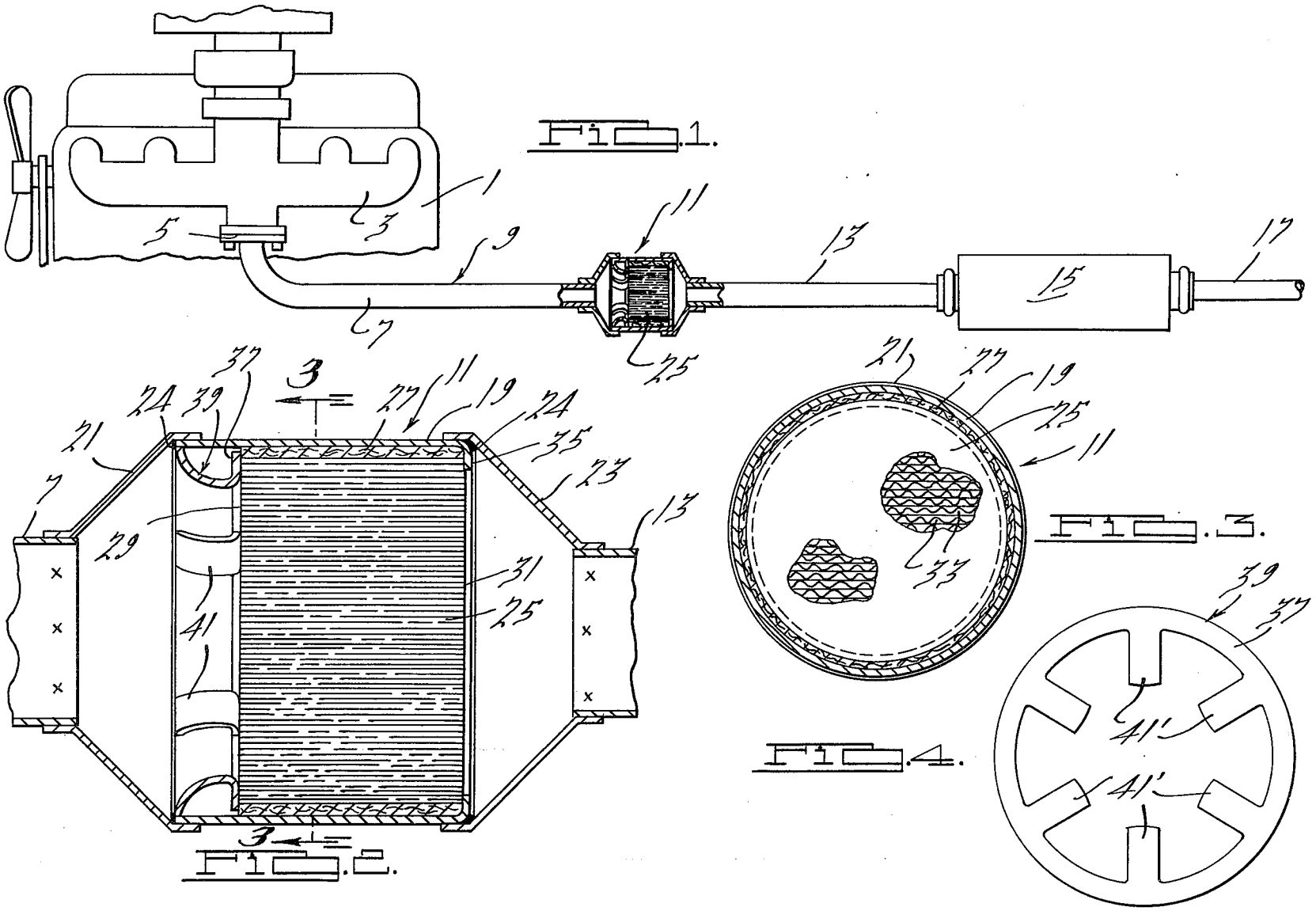
FIG. 1 is a schematic side elevation, partly in section, of an internal combustion engine exhaust embodying the invention.
FIG. 2 is an enlarged axial section through the converter unit of FIG. 1.
FIG. 3 is a cross section along the line 3—3 of FIG. 2.
FIG. 4 is a detail end elevation of the special resilient mounting member and shows the blank prior to formation of the fingers.
Figure 5:
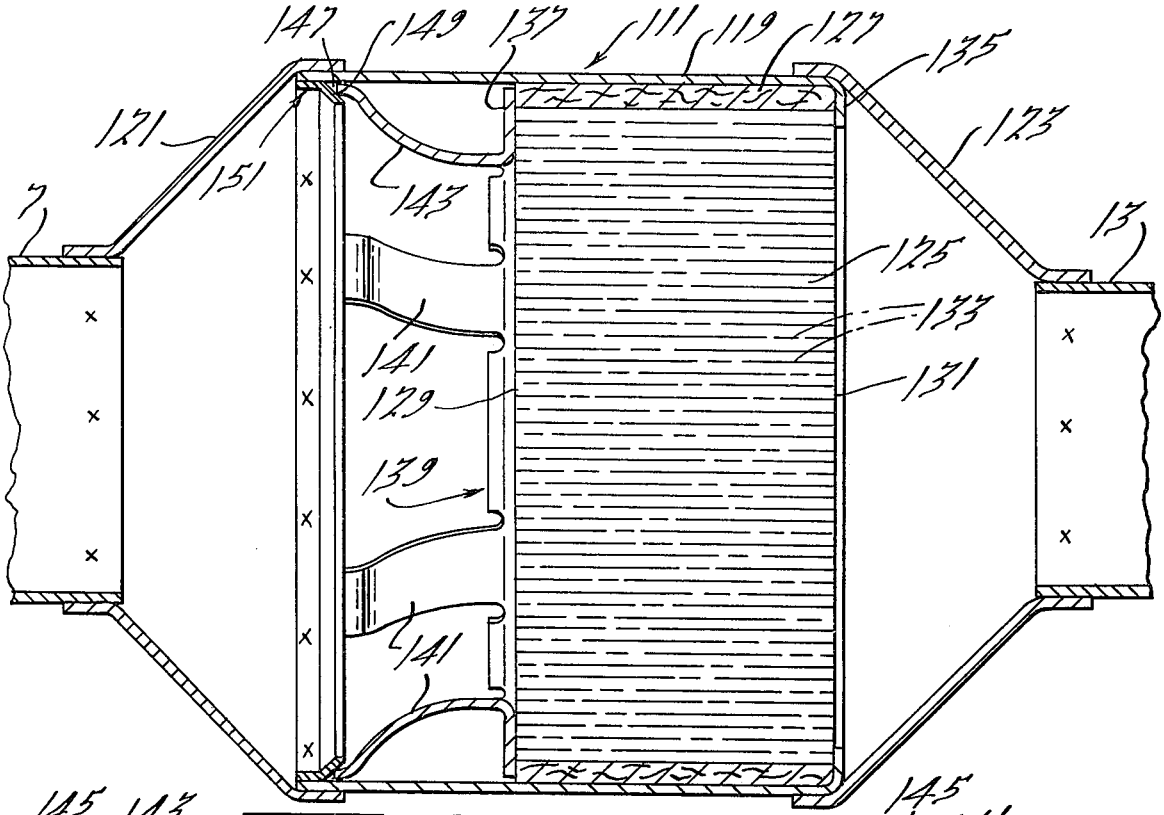
FIG. 5 is an axial section through a converter having a modified resilient mounting means.
Figure 8:
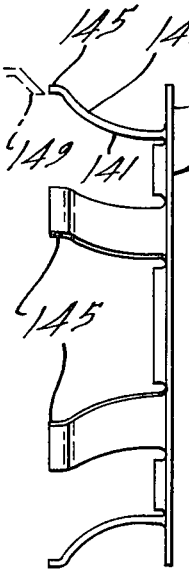
FIG. 8 is a reduced side elevation of the resilient ring with the fingers in relaxed condition.
Figure 6:
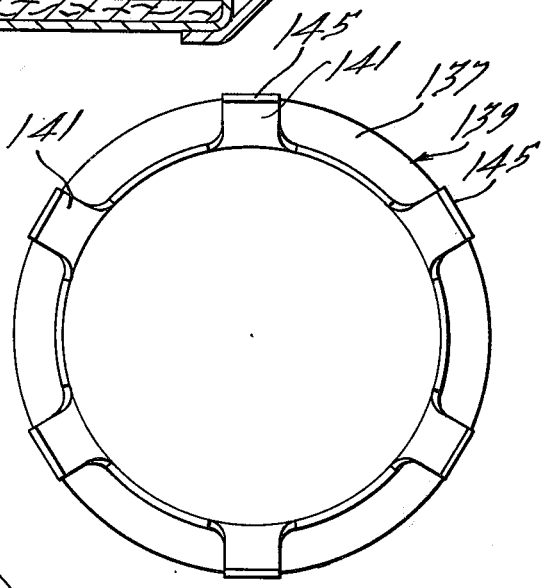
FIG. 6 is a plan detail view on a reduced scale of the resilient ring of FIG. 5.
Figure 7:
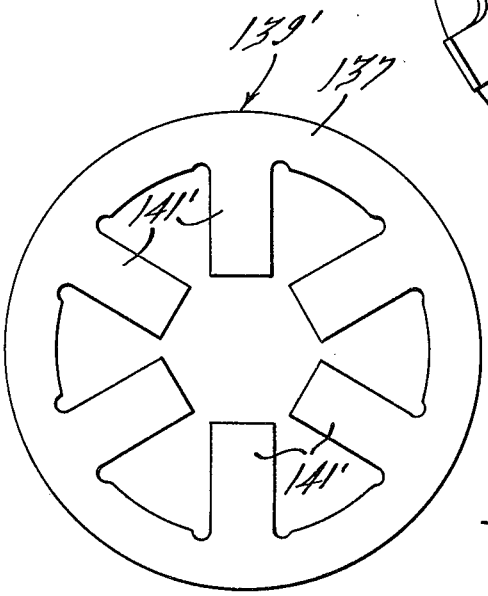
FIG. 7 is a plan view of the blank from which the ram of FIG. 6 may be joined.

An internal combustion engine 1 has an exhaust manifold 3 which discharges gas through its outlet 5 into the inlet or exhaust conduit 7 of an exhaust system 9 containing a catalyst unit 11. In the system shown, the unit 11 discharges exhaust gas into a connecting conduit 13 which carries it to a sound attenuating muffler 15 that discharges into a tailpipe 17 that conducts the gas to atmosphere.

The catalyst unit 11 is of the type known in the art and described in U.S. Pat. No. 3,441,381. It has a tubular (preferably circular) outer shell 19 that extends between and is secured to an inlet cone 21 and an outlet cone 23 which, respectively, are secured to conduits 7 and 13, preferably by welds 24. A cylindrical, monolithic, refractory ceramic, honeycomb catalyst element 25 is coaxially supported inside and on the wall of shell 19 by a mounting system that may include a resilient annular layer 27. The element 25 has an inlet face 29 and an outlet face 31 and is characterized by a great number of longitudinal cells, channels, or passages 33 that extend through it and connect the inlet face to the outlet face. The catalyst material is deposited on the walls of the passages 33 and promotes the conversion of undesirable constituents in exhaust gas flowing through the element 25. Heat is released to a greater or lesser degree in the element, depending on the constituents converted, and it is to be expected that in actual usage the temperature differential between at least the inner portions of body 25 and the shell 19 may, at times, substantially exceed 1000° F. Since the refractory ceramic material of which the element 25 is composed is weak and brittle, it is evident that temperature differentials of this order can give rise to destructive forces, particularly where the coefficient of thermal expansion of element 25 (approximately $2.1 \times 10^{-6}$ in./in./°F) is several times less than that of the metal shell 19. Conversely, at ambient temperatures upon start up of the engine, the components may be at the same temperature giving rise to clearances and the deleterious effects of vibration and relative movement.

The resilient mounting layer 27 may be some form of metal, such as wire mesh, or an appropriate yeildable cement such as Fiberfrax, which is a fibrous ceramic cement (alumina silicate). Some slight axial movement or shifting of the element 25 relative to the shell is accommodated by the layer 27. If a resilient ceramic layer 27 is utilized it also acts as a heat insulator to accentuate the temperature differential between the element 25 and the metal container 19.

In order to provide a positive barrier to bypassing of the passages 33 by gas flow around the outside of the element 25, an annular flange or barrier 35 is utilized to block or seal off the outlet end of the annular space for the resilient sleeve 27. In the embodiment shown, the gas seal barrier and positioning shoulder 35 is formed as a flange on the downstream end or foot of the tubular outer shell 19. The element 25 is yieldably held against barrier 35 by an annular shoulder that is formed as the downstream end of a ringlike resilient mounting member or clamp 39.

The member 39 has a plurality of resilient fingers 41 extending away from the annular flange 37. FIG. 4 shows the flat stamped metal blank with the finger forming portions 41' extending in from the rim 37. The fingers are reversely bent, as seen best in FIG. 2 so that the ends are axially spaced from the flange 37. These ends are suitably anchored or affixed to the inlet end of the outer shell 19, such as by the welds 24 that secure the cone 21 to the shell. The fingers are preloaded (i.e. elastically bent somewhat when the member 39 is installed at room temperature) to a predetermined deflection. This enables the flange 37, which is free to move relative to shell 19, to maintain pressure on the monolith at all times. Because the yield strength of metal drops drastically at the elevated temperatures encountered in the unit, the resiliency of the fingers is augmented by the selection of a metal with a proper coefficient of thermal expansion.

In practical applications of the invention, it is contemplated that the shell 19 and cones 21 and 23 will be of a suitable stainless heat and corrosion resisting steel, such as the composition designated 409. As indicated, the member 39 is of a different composition, having a greater coefficient of thermal expansion, such as stainless steel composition 304. 304 stainless is austenitic and has a coefficient of about $10.6 \times 10^{-6}$ in./in./°F and 409 stainless is martensitic and has a coefficient of about $7.2 \times 10^{-6}$. Because the shell 19 and the member 39 are attached only at the ends of fingers 41, they can expand axially relatively to each other. The flange 37 is smaller than the inside of the shell 19, as shown, so that relative transverse thermal expansion does not interfere with the axial or linear expansion of the sleeve relative to the shell.

FIGS. 5 – 8 show a modified and presently preferred form of the invention wherein the resilient ring is mechanically anchored in position. Here the converter unit 111 has an outer shell 119 which is welded at opposite ends to cones 121 and 123 which are connected at their reduced diameter portions to conduits 7 and 13. The catalyst element 125 is supported inside the shell by a mounting system including annular resilient layer 127, the element having an inlet face 129 and an outlet face 131 and a large number of catalyst containing gas flow passages 133 extending through it to connect the two faces. The downstream end of shell 119 is turned inwardly in a flange 135 that serves as a gas seal barrier to gas flow along the outside of the element 125. A shoulder 137 pressing on the upstream end of the element is provided by the annular base of the resilient mounting member or clamp 139 which is similar to member 39. It has a plurality of resilient cantilever fingers 141 extending from the inside diameter of the flange or base 137. In the flat stamped blank 139' of FIG. 7 the fingers 141' are formed to extend radially inwardly. They are subsequently bent to extend axially and curved radially outwardly as seen at 143 at their outer ends and terminate in axial tips 145. The tips 145 fit in the conical space 147 that is formed between the downstream conical end 149 of retainer ring 151 and the inside of the shell 119, the end 149 preferably being a little larger on its inner periphery than the outer diameter of monolith 125 and tapered on a 45° angle. The ring is preferably formed of the same metal as cones 121 and 123 and shell 119 and welded to the shell. In relaxed condition of fingers 141 (FIG. 8), they preferably approximately coincide with the inner diameter of the ring end 149. However, the relative position of ring 151 with respect to catalyst face 129 and length of member 139 are such that the tips 145 are cammed outwardly at assembly to fit in the bottom of the conical groove 147, thereby preloading the fingers. Since the resilient member 139 is floating between retainer ring 151 and the catalyst element 125, the finger preload provides resilient pressure at all times holding the catalyst against barrier 135 to overcome clearance. The fingers also provide resiliency to absorb forces of temperature differentials when there would otherwise be excessive compression on the catalyst. Member 139 is preferably 304 stainless steel and shell 119, cones 121 and 123, and ring 151 are preferably 409 stainless steel.

The metallic shells 19 and 119 are several times more dimensionally responsive to heat than the monoliths 25 and 125 and this is magnified by the substantially greater length of the shell. Hence, if barrier 35 and shoulder 37 (or 135 and 137) are both fixed to the shell and of conventional structure there may be temperature conditions in which the distance between them is grossly more or less than the length of the catalyst resulting in catalyst damage. To overcome this the present invention provides a mounting system for the catalyst that includes a growth responsive clamp design with built-in resiliency and also built-in temperature compensation. The built-in resiliency is provided by the preloaded fingers 41 or 141. The temperature compensation is provided by forming the members 39 or 139 from metal that has a substantially greater coefficient of thermal expansion than the shell 19 or 119, a feature that is explained more fully in a copending U.S. application, assigned to the present assignee, of Balluff and Stormont, entitled "Container for Monolithic Catalyst", Ser. No. 342,280, Filed March 16, 1973. The effect of the compensation is to cause the longitudinal distance between the barrier 35 and shoulder 37, or 135 and 137, to vary with temperature more nearly in accordance with temperature produced variations in length of the monoliths 25 or 125. The axial lengths of high expansion rate fingers 41 and 141 tends to overcome the low expansion rate of the monolith.

Thus, knowing the differentials of thermal growth of the shell and monolith, the members 39 or 139 are formed from a practical metal or material whose coefficient of thermal expansion will most closely compensate for the growth differentials. The member 39 or 139 is also designed with features that allow sufficient resiliency to maintain retention pressure on the monolith at all times but not crush it or permit it to be crushed when temperature differentials cause a compression condition.

Modifications in the specific details disclosed may be made without departing from the spirit and scope of the invention. For example, the unit 11 or 111 may be non-circular in cross section, the barrier forming means may be of a different configuration or construction, and the specific metals mentioned may vary all within the broad purview of the invention.

I claim:

1. A catalytic converter unit adapted for use in the exhaust system of a combustion engine comprising, a housing having a cylindrical shell and end members attached to opposite ends of the shell and providing respectively and inlet and outlet for said converter unit, a unitary block-like refractory monolithic honeycomb catalyst element supported in said shell, differential growth compensating clamp means for holding the catalyst element in a desired longitudinal position in the shell comprising a first member that is integral with said shell and substantially rigid with respect to the shell and having a first shoulder for operative engagement with the element to oppose movement thereof in one longitudinal direction and a second member having a second shoulder for operative engagement with an outer circumferential annular portion of the element to oppose movement thereof in the opposite longitudinal direction, said second member being longitudinally resilient and acting to apply continuous pressure to hold the element against the first shoulder, said members having thermally expansive lengths and said length of the first member being greater than said length of the second member, both said members being composed of metal and having coefficients of thermal expansion greater than that of the catalyst element and said coefficient of the second member being greater than that of the first member and providing a differential thermal compensating means for the lesser rate of thermal expansion of the element as compared to the shell over the entire temperature range to be experienced by the converter, said second member being annular and including a multiplicity of circumferentially separated reversely bent and bowed spring fingers extending axially away from said second shoulder to make said second member longitudinally resilient, and means anchoring the ends of said spring fingers remote from said element to said shell and maintaining said fingers in a continuous state of tension at all temperatures of the converter.

2. A catalytic converter adapted for use in the exhaust system of a combustion engine and comprising a tubular metal shell having end caps attached thereto at opposite ends thereof, said end caps containing respectively an inlet and outlet for said convertor, said shell and end caps providing a housing for the converter, a refractory monolithic honeycomb catalyst element yieldably supported in said shell and having a rate of thermal expansion substantially less than that of the shell, a rigid part of said housing forming first means providing a first shoulder that is of fixed position with respect to the housing engaging an end of the element to position it in said housing, second means in the shell providing a second shoulder engaging the other end of the element to position it in said shell and spaced a longitudinal distance from the first shoulder, and differential thermal expansion compensating means including said second means for applying continuous resilient axial pressure on said element so that variations of said distance due to changes in temperature correspond substantially with variations in the length of the element due to changes in temperature, said second means including spring means having a rate of thermal expansion substantially greater than that of the housing and element thereby applying continuous axial pressure to said element over the temperature range of the converter to hold it against said first shoulder, said spring means comprising washer engaging an outer circumferential annular portion on the other end of the element, said washer including as a part thereof a multiplicity of reversely bent and bowed spring fingers extending from the inside circumference of said annular portion and axially away from and radially outwardly from said inside circumference and being circumferentially spaced from each other around the inner circumference of the washer, and means anchoring the ends of said spring fingers remote from said element to said shell and maintaining said fingers in a continuous state of tension at all temperatures of the converter.

3. A catalytic converter unit adapted for use in the exhaust system of a combustion engine comprising a substantially uniform diameter tubular metal shell having a longitudinal axis with an inlet at one end and an outlet at the other end, said shell having its downstream end bent inwardly to form a radial flange, a monolithic refractory catalyst element resiliently supported in said shell and having the outermost peripheral portion of its downstream end positioned against said radial flange, a one piece metal mounting member inside said shell and having an annular rim at its downstream end positioned against the outermost peripheral portion of the upstream end of the element, said member having integral with the rim a plurality of reversely bent resilient cantilever fingers extending axially upstream from the inside circumference of the rim and circumferentially separated from each other and extending radially outwardly and connected at their upstream ends to said shell and preloaded to apply axial pressure to the element at all times tending to hold said element against said radial flange, said metal mounting member having a greater rate of thermal expansion than said metal shell and said catalyst element having a lesser rate of thermal expansion than both said mounting member and said shell whereby the greater thermal expansion rate of the mounting member as compared with the shell tends to compensate for the lesser rate of thermal expansion of the catalyst element as compared to the shell.

4. A unit as set forth in claim 3 including means welding the remote ends of the fingers to the shell.

5. A unit as set forth in claim 3 including a retaining ring secured inside said shell on the upstream side of said element, the upstream ends of said fingers abutting said ring, the downstream end of the ring being conical to provide a tapered annular groove receiving the ends of said fingers and the ends of said fingers being seated in said groove against the ring but movable relative to the ring.

6. A unit as set forth in claim 3 wherein said radial flange forms a gas seal to inhibit bypass gas flow around the outside of the element.

7. A unit as set forth in claim 3 wherein said annular rim is smaller in diameter than the inner diameter of the tubular shell so that the rim can move axially relative to the shell and maintain continuous axial pressure on the catalyst element.

8. A catalytic converter unit adapted for use in the exhaust system of a combustion engine, said unit including a metal housing having an inlet and an outlet for gas, a unitary block-like refractory monolithic catalyst element resiliently supported in said housing, a differential growth compensating clamp arrangement for substantially holding the catalyst element in a desired longitudinal position in the housing comprising a first means having a substantially rigid and immobile first annular shoulder for operative engagement with an end portion of the element adjacent the outer periphery of the element to oppose movement thereof with respect to the housing in one longitudinal direction and a second means resilient in nature and having a second and movable annular shoulder for operative engagement with an end portion of the element adjacent the outer periphery of the element to oppose movement thereof with respect to the housing in a longitudinal direction away from said first shoulder, said second means including a series of reversely bent circumferentially separate axially and radially projecting and axially preloaded bowed spring fingers spaced circumferentially from each other and extending from the second annular shoulder and having ends remote from the second annular shoulder anchored on said housing and applying axial pressure at all times thereby tending to hold said catalyst element against said first annular shoulder, said second means having a substantially greater rate of thermal expansion than said housing and both said second means and said housing having a substantially greater rate of thermal expansion than said catalyst element whereby the greater rate of thermal expansion of said second means as compared with said housing tends to compensate for the lesser rate of thermal expansion of the catalyst element as compared to the housing.

9. A unit as set forth in claim 8 including weld connections between the ends of said fingers and said housing.

10. A unit as set forth in claim 8 including a ring fixed inside said housing providing a one way mechanical connection between the ends of said fingers and said housing serving to prevent movement of the fingers in a direction away from the element and to hold them under axial preload.

11. A unit as set forth in claim 10 wherein said one way mechanical connection comprises a shoulder on the ring facing the element and engaging the ends of the fingers.

12. A unit as set forth in claim 11 wherein said shoulder is tapered and which in combination with said housing provides a tapered groove receiving the ends of the fingers.

* * * * *